United States Patent [19]

Morimoto et al.

[11] Patent Number: 4,666,415

[45] Date of Patent: May 19, 1987

[54] LINEAR ELECTRODE CONSTRUCTION FOR FLUORESCENT DISPLAY DEVICE AND PROCESS FOR PREPARING SAME

[75] Inventors: Kiyoshi Morimoto; Hiroshi Watanabe; Yoshihisa Tsuruoka, all of Mobara, Japan

[73] Assignee: Futaba Denshi Kogyo Kabushiki Kaisha, Mobara, Japan

[21] Appl. No.: 878,692

[22] Filed: Jun. 26, 1986

Related U.S. Application Data

[62] Division of Ser. No. 596,683, Apr. 4, 1984, Pat. No. 4,626,741.

[30] Foreign Application Priority Data

Apr. 8, 1983 [JP] Japan ..... 58-51457
Apr. 8, 1983 [JP] Japan ..... 58-60959

[51] Int. Cl.[4] ..... H01J 9/14
[52] U.S. Cl. ..... 445/24; 445/33
[58] Field of Search ..... 445/24, 25, 29, 33

[56] References Cited

U.S. PATENT DOCUMENTS

| | | | |
|---|---|---|---|
| 3,722,044 | 3/1973 | Law | 445/37 |
| 3,894,321 | 7/1975 | Moore | 445/37 |
| 4,304,450 | 12/1981 | Bilsback et al. | 445/24 |
| 4,516,053 | 5/1985 | Amano | 313/584 |

*Primary Examiner*—Kenneth J. Ramsey
*Attorney, Agent, or Firm*—Oblon, Fisher, Spivak, McClelland & Maier

[57] ABSTRACT

A linear electrode construction for a fluorescent display device which is capable of providing the high densification of luminous display is disclosed. The linear electrode construction includes two electrode frames each comprising a plurality of linear electrodes arranged side by side at intervals of a predetermined distance and each having a fine wire-like electrode portion and a connecting terminal portion formed at one end of the electrode portion. The fine wire-like electrode portions are uniformly applied thereto tension to prevent the sagging in the operation. Also, a process for preparing such a linear electrode construction is disclosed.

2 Claims, 6 Drawing Figures

LINEAR ELECTRODE CONSTRUCTION FOR FLUORESCENT DISPLAY DEVICE AND PROCESS FOR PREPARING SAME

This is a division of application Ser. No. 596,683, filed Apr. 4, 1983 now U.S. Pat. No. 4,626,741.

BACKGROUND OF THE INVENTION

1. Field of the Invention

This invention relates to a linear electrode construction for a fluorescent display device and a process for preparing the same, and more particularly to a linear electrode construction adapted to allow a fluorescent display device to carry out graphical display and the like with high density and a process for preparing the same.

2. Description of the Prior Art

A fluorescent display device is generally constructed to carry out luminous display by impinging electrons emitted from a filamentary cathode on an anode having a phosphor layer deposited thereon and selectively applied thereto anode potential. Such a fluorescent display device has been extensively used in a display system for various types of electronic devices, electric machines, and the like, because it provides a good luminous display with low voltage, is low in power consumption, is driven directly by LSI and provides display different in luminous color depending upon phosphor to be used.

In such a fluorescent display device, it is highly desired to provide not only display of simple numeral or character but display of figure, image or the like as desired. Also, it is desired in the art to attain high densification of display in order to obtain dense display. Such high densification of display requires to arrange a plurality of linear electrodes such as control electrodes for selecting desired picture cells at intervals of 0.2–0.5 mm and at most 1 mm in a space defined between an anode and a cathode while keeping a distance between the linear electrodes and each of the anode and cathode. Also, this requires to uniformly apply suitable tension to the linear electrodes in order to prevent short-circuit due to the contact therebetween and absorb elongation thereof due to exposure of the linear electrodes to heating in the operation.

A conventional fluorescent display device adapted to provide graphical display and tht like is generally constructed in a manner to stretch fine wires of a uniform section in a vacuum casing and lead out both ends of the wires to the vacuum casing without subjecting the ends of the wires to any treatment to form the connection with an external circuit. Thus, such linear electrode construction in the conventional device raises a problem that the connection between both ends of the wires and the external circuit is not satisfactory because the both ends have a highly small area of contact with the external circuit to render soldering therebetween difficult. Another problem encountered with the conventional linear electrode construction is that the intervals between the fine wires are apt to be ununiform in the manufacturing process. Further, in the conventional construction, it is required to cut away the lead-out portions of the wires unnecessary for the connection with the external circuit. Nevertheless, it is highly troublesome to select such unnecessary lead-out wires. A further difficulty in the conventional linear electrode construction is that uniform tension is hard to be applied to all the wires because the wires have an extremely small section. Still a further problem is that the connection between the fine wires and the external circuit is readily injured because the lead-out portion of each wire is fine.

Thus, the conventional linear electrode construction does not allow a fluorescent display device to attain stable luminous display with high density.

SUMMARY OF THE INVENTION

The present invention has been made in view of the foregoing disdavantage of the prior art.

Accordingly, it is an object of the present invention to provide a linear electrode construction for a fluorescent display device which is capable of keeping the intervals between the connecting portions of adjacent linear electrodes and the intervals between the fine wire-like electrode portions of the linear electrodes uniform, respectively.

It is another object of the present invention to provide a linear electrode construction for a fluorescent display device which is capable of readily and effectively carrying out the connection with an external control circuit and highly readily selecting the fine wire-like electrode portions unnecessary for the connection with the external circuit to cut away the portions.

It is a further object of the present invention to provide a linear electrode construction for a fluorescent display device which is capable of uniformly applying to all the fine wire-like electrode portions tension sufficient to prevent the sagging during the operation with good reproducibility, to thereby carry out stable luminous display with high density.

It is still a further object of the present invention to provide a process for preparing a linear electrode construction for a fluorescent display device which is capable of readily providing a linear electrode construction adapted to accomplish stable luminous display with high density.

In accordance with one aspect of the present invention, there is provided a linear electrode construction for a fluorescent display device comprising anodes each having a phosphor layer deposited thereon, control electrodes and a cathode means arranged in a vacuum casing of said fluorescent display device which is formed by hermetically sealing a substrate and a front cover through side plates. At least one of the anodes and the control electrodes each include an electrode portion formed into a fine wire-like shape and a connecting terminal portion integral with the electrode portion at one end thereof. The connecting terminal portion is formed to have a width larger than the electrode portion and is securely interposed between the side plates and substrate, and arranged side by side at the exterior of the vacuum casing. The fine wire-like electrode portions is fixed between the substrate and plates opposite to the side plates on which the corresponding connecting terminal portions are fixed.

According to another aspect of the present invention, there is provided a process for preparing a linear electrode construction for a fluorescent display device comprising the steps of forming at least one electrode frame by arranging fine wire-like electrode sections side by side at intervals of a predetermined distance and forming connecting terminal sections integral with the electrode sections at both ends thereof which have a width larger than the electrode sections, the connecting terminal sections at both ends of each of the electrode sections being formed to be different in length from each other; stretching the electrode frame in a space defined above a substrate forming a part of a vacuum casing of the fluorescent display device; applying tension to the fine wire-like electrode sections of the electrode frame in the longitudinal direction thereof and mounting the electrode frame with respect to the vacuum casing in a manner to lead out the electrode sections and connecting terminal sections of the electrode frame to the exterior of the vacuum casing through a spacer means fixed on the substrate; and cutting away the portions of the electrode sections outward extending from the vacuum casing.

BRIEF DESCRIPTION OF THE DRAWINGS

Other objects and many of the attendant advantages of the present invention will be readily appreciated as the same becomes better understood by reference to the following detailed description when considered in connection with the accompanying drawings in which like reference characters designate the same parts throughout the figures thereof and wherein.

DETAILED DESCRIPTION OF THE PREFERRED EMBODIMENT

Now, a linear electrode construction for a fluorescent display device according to the present invention will be described by way of example with reference to the accompanying drawings.

An electrode construction adapted to display characters, graphic forms and the like with high density is generally of two types. The first type is one which forms a matrix utilizing an anode having a phosphor layer deposited thereon and divided into a stripe-like shape and a plurality of linear control electrodes arranged in the direction perpendicular to the anode to cause selective emission at the intersections therebetween. The second type is one which forms a matrix by a cathode and an anode or control electrode to select picture cells necessary to carry out desired display. The following description will be made with respect to the former type.

Figure 1:
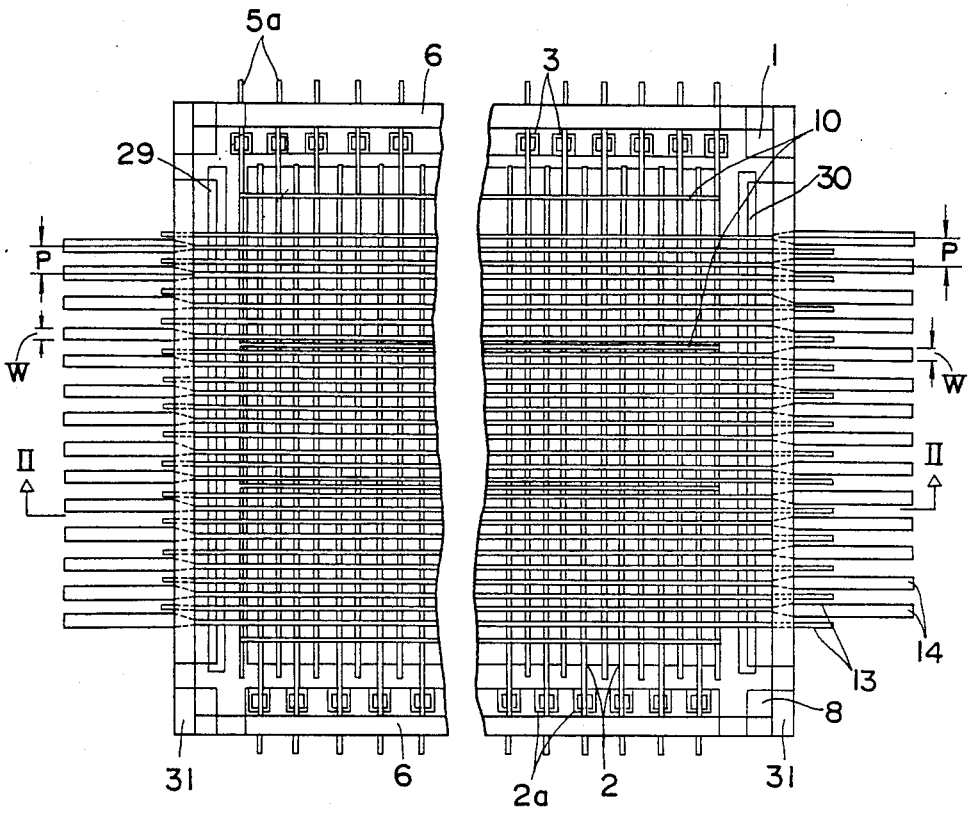
FIG. 1 is a plan view illustrating an example of a fluorescent display device in which an embodiment of a linear electrode construction according to the present invention is incorporated.
Figure 2:
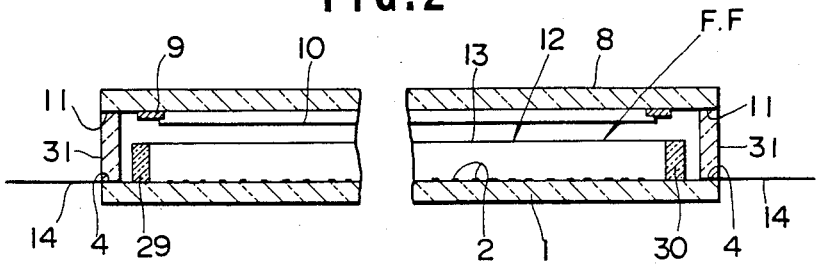
FIG. 2 is a sectional view taken along line II—II of FIG. 1.

FIGS. 1 and 2 are a plan view and a sectional view illustrating an example of a fluorescent display device in which one embodiment of a linear electrode construction according to the present invention is adapted to be incorporated. The illustrated fluorescent display device includes a substrate or base plate 1 formed of an insulating material such as glass, ceramic or the like. The substrate 1 is desirably formed of a transparent insulating material, when the fluorescent display device is of the front emission type wherein display is viewed through such a substrate. The substrate 1 is provided on the inner surface thereof with a plurality of anode conductors 2, which are formed of a conductive metal film such as an A1 film by photo-etching and arranged side by side in a stripe shape. The anode conductors 2 each are formed at one end thereof with an anode terminal 2*a* in such a manner that the anode terminals of the adjacent anode conductors are alternately arranged opposite to one another. In a fluorescent display device for observing the display on the substrate side, the anode conductors 2 is desirably formed of a transparent conductive film or a mesh-like conductive metal film.

The anode terminals 2*a* each are formed thereon with a terminal 3 by applying thereto a conductive glass adhesive made of glass of a low melting point such as frit glass and conductive metal such as Ag by printing. Also, the substrate 1 has glass adhesive such as frit glass deposited on the periphery thereof by printing and is attached thereto an evacuation tube (not shown).

The illustrated fluorescent display device, as shown in FIGS. 1 and 2, also includes a front cover 8, which has a cathode mount plate 9 mounted on the inner surface thereof by means of glass adhesive such as frit glass. The cathode mount plate 9 serves to hold filamentary cathodes thereon in a manner to be stretched in the direction perpendicular to the anode conductors 2. The front cover 8 has glass adhesive 11 applied to the outer periphery of the inner surface thereof by printing.

Now, linear electrodes 12 acting as control electrodes arranged between the anode conductors 2 on the substrate 1 and the cathodes 10 on the front cover 8 will be described with reference to the drawings.

Figure 3:
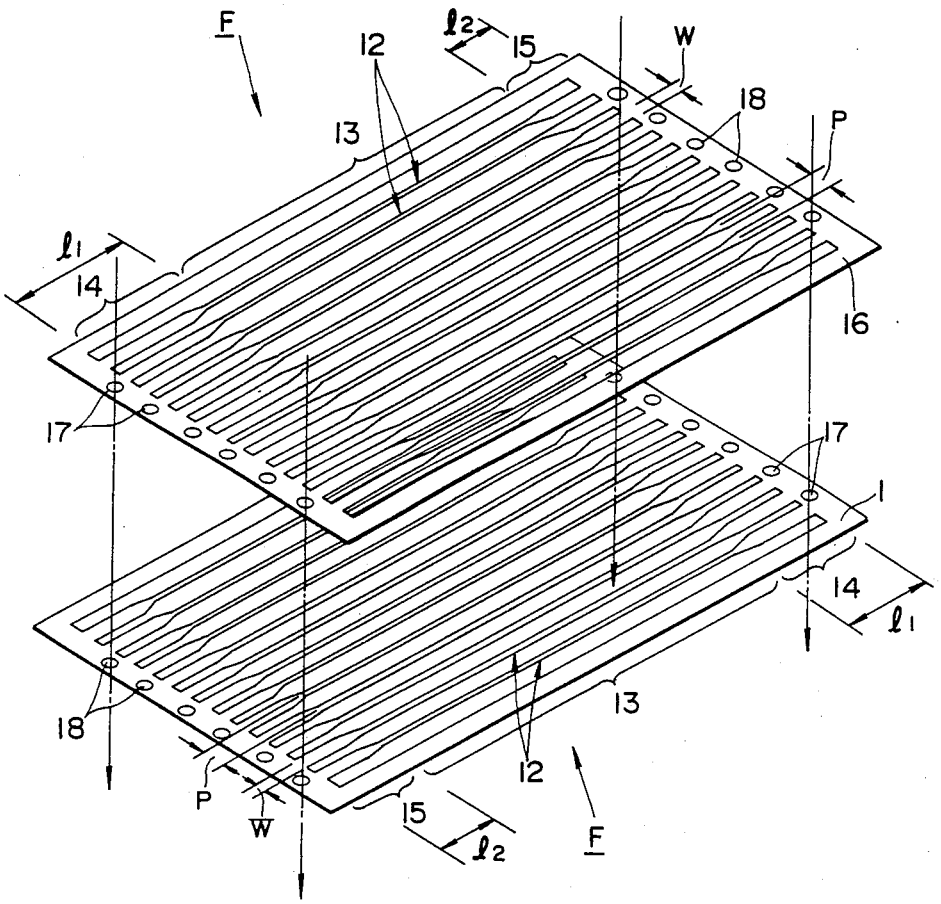
FIG. 3 is a perspective view showing the manner of superposing two electrode frames on each other.

The linear electrodes 12, as shown in FIG. 3, are formed into an electrode frame F by subjecting a conductive flat metal sheet to an etching treatment and each comprises a fine wire-like electrode portion 13 and wide flat connecting portions 14 and 15 integrally formed at both ends of the electrode portion 13. The connecting portion 14 is formed to have a length $l_1$ larger than that $l_2$ of the opposite connecting portion 15. Also, the linear electrodes 12 are formed in a manner such that the width of each of the connecting portions 14 and 15 is smaller than the interval p of a predetermined distance between the adjacent electrode portions 13 but is as large as possible within the limits of not causing the adjacent connecting portions to contact with each other. The linear electrodes 12 are arranged side by side in a frame section 16 of a rectangular shape to be integral therewith and the frame section 16 is formed therethrough a plurality of positioning holes 17 and 18 in proximity to the connecting portions 14 and 15.

Figure 4:
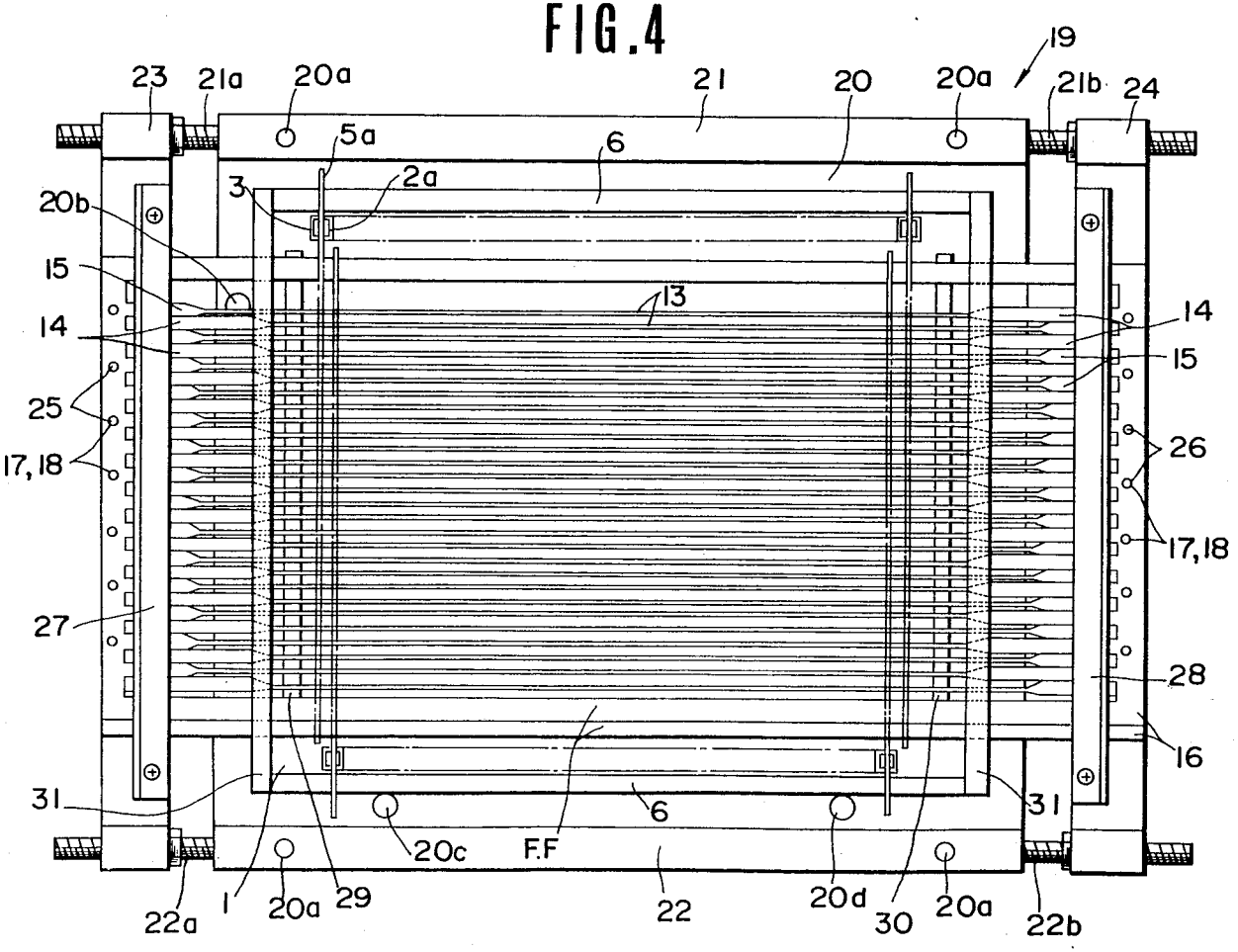
FIG. 4 is a plan view showing an electrode fixture by which two electrode frames are fixedly positioned with respect to each other.
Figure 5:
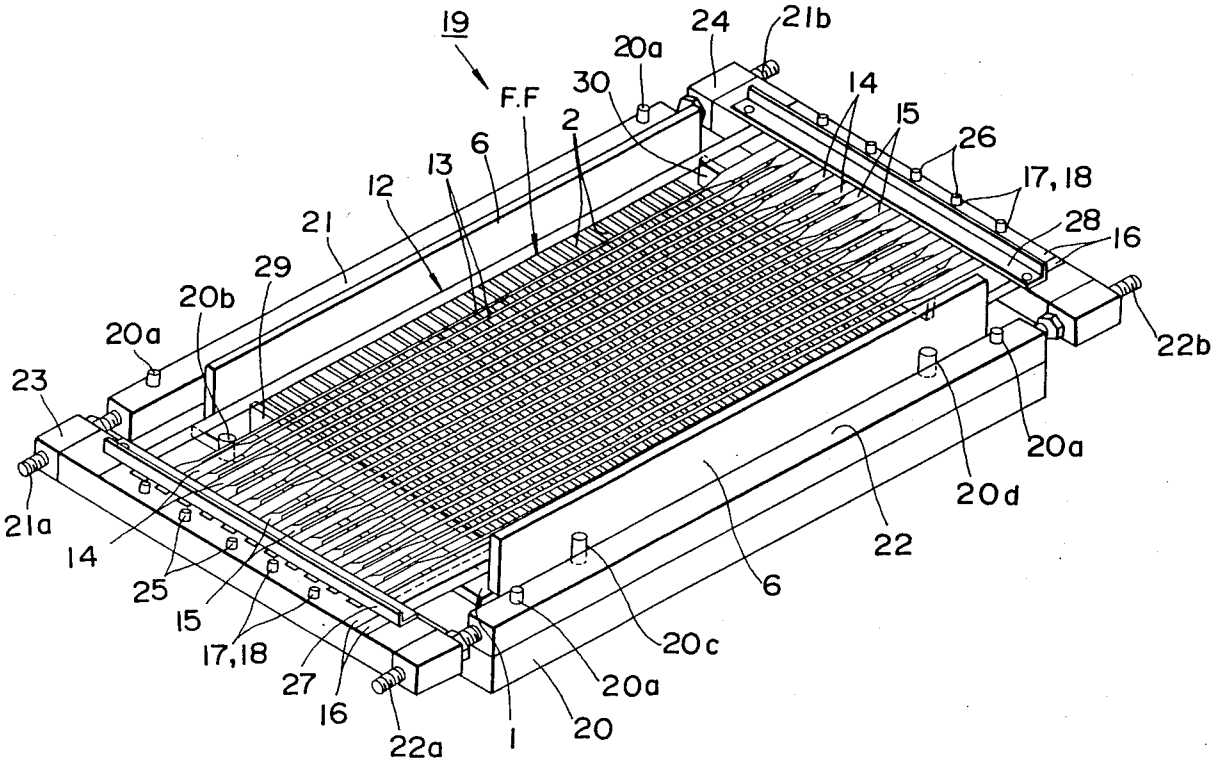
FIG. 5 is a perspective view of the electrode fixture shown in FIG. 4.

Two electrode frames F each comprising the frame section 16 and a plurality of the linear electrodes 12 each including the electrode portion 13 and the connecting portions 14 and 15 as described above are superposed on each other in a manner to be horizontally shifted from each other at an angle of 180 degree, and are stretched between the substrate 1 and the front cover 8 by means of an electrode fixture 19, as shown in FIGS. 4 and 5.

Now, the structure of the electrode fixture 19 will be described with reference to FIGS. 4 and 5.

The electrode fixture 19 generally comprises a base plate 20 of a rectangular shape adapted to dispose the substrate 1 thereon, a pair of supporting rods 21 and 22 engaged with four projecting pins 20*a* provided on the corner portions of the base plate 20 to be mounted thereon, and a pair of lateral tension members 23 and 24 movably fitted on the male screws 21*a*, 22*a* and 21*b*, 22*b* provided at the respective ends of the supporting rods 21 and 22 to mount the two electrode frames F to the fixture 19 in view of the size of the frames and apply longitudinal tension to the frame. The base plate 20 is vertically formed at the three suitable portions thereof with positioning pins 20*b*, 20*c* and 20*d* which serve to position the substrate 1 on the base plate 20.

The tension members 23 and 24 are formed to be symmetrical with each other. The tension members 23 and 24 are provided on the upper surfaces thereof with a plurality of fitting pins 25 and 26 fitted in the positioning holes 17 and 18 and holding plates 27 and 28 for fixing the electrode frames F with respect to the tension members 23 and 24, respectively.

The supporting rods 21 and 22 are formed of a material such as SUS 304 stainless steel which has a thermal expansion coefficient several times, preferably 1.5–2.0 times as large as that of the electrode frame F.

Now, the manner of assembling the fluorescent display device will be described.

First, the substrate 1 formed thereon with the anode conductors 2 as shown in FIGS. 4 and 5 is temporarily securely provided on both ends of the inner surface thereof with spacers 29 and 30 of an elongated strip shape by means of glass adhesive such as frit glass which are formed of a transparent or opaque insulating material such as glass. Then, the substrate 1 is placed on the base plate 20 of the fixture 19 in a manner such that the spacers 29 and 30 look upward, and is contacted with the three positioning pins 20*b*, 20*c* and 20*d* to be positioned in place. The substrate 1 has a pair of longitudinally extending side plates 6 previously temporarily fixed thereon by means of glass adhesive 4.

Then, as shown in FIG. 3, one electrode frame F is superposed on the other one F in a state of being horizontally shifted by an angle of 180 degrees from each other, and positioning holes 17 and 18 of the electrode frame F are aligned with each other as shown in FIGS. 4 and 5. This results in the shorter connecting portions 15 of one electrode frame F being interposed between the longer ones 14 of the other electrode frame so that the shorter and longer connecting portions 15 and 14 are alternately positioned, and the adjacent fine wire-like electrode portions of the opposite electrode frames F are arranged side by side with a fixed microgap of a distance half the interval P being defined therebetween.

The electrode frames F superposed on each other are then positioned on the tension members 23 and 24 by fitting the pins 25 and 26 of the members 23 and 24 in the holes 17 and 18 aligned with each other and fixedly mounted thereon by means of the holding plates 27 and 28. Then, the supporting rods 21 and 22 are fixedly mounted on the base plate 20 of the fixture 19 through the projecting pins 20*a* in a state that the two electrode frames F are stretched between the tension members 23 and 24.

Further, a pair of side plates 31 perpendicular to the side plates 6 are mounted on the substrate 1 through the electrode frames F by means of the glass adhesive 4, and the front cover 8 is disposed on the side plates 6 and 31 in a manner such that the cathodes 10 look downward to face the electrode frames F.

Figure 6:
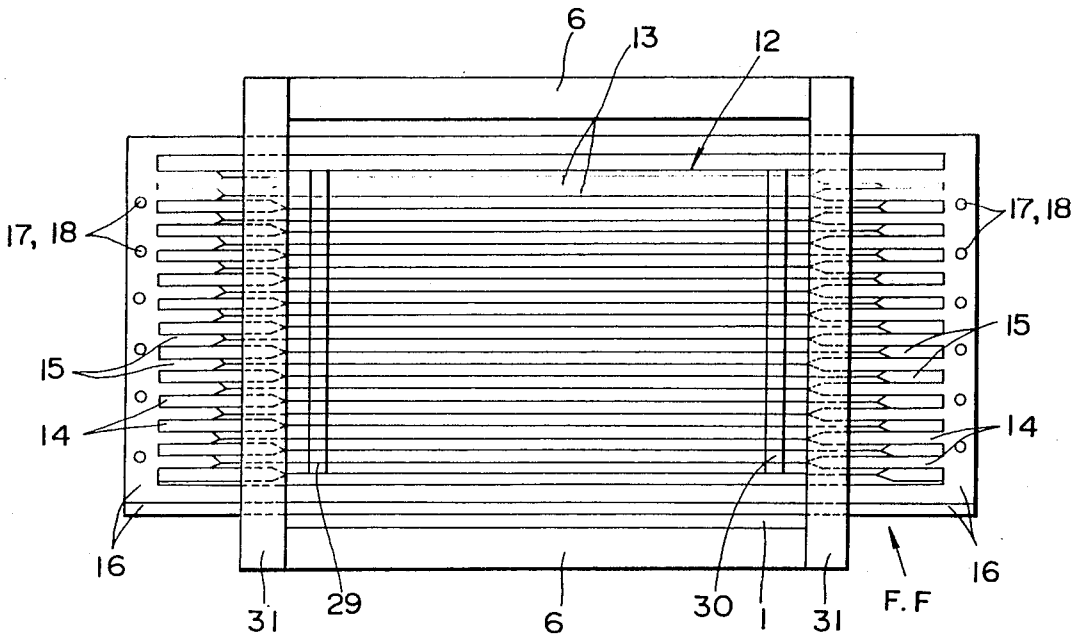
FIG. 6 is a schematic plan view showing the positional relationships among side plates, spacers and two electrode frame.

In such state, the fine wire-like electrode portions 13 of one of the electrode frames F are placed at both ends thereof on the spacers 29 and 30 as shown in FIGS. 4, 5 and 6. Also, between the side plates 31 and the substrate 1, the longer connecting portions 14 of the one electrode frame F and the fine wire-like electrode portions 13 of the other electrode frame are alternately arranged side by side.

The so-assembled fluorescent display device is vertically pressed by a suitable means such as a clip and then placed in an oven leaving the electrode fixture 19 incorporated therein to be subjected to a heating and burning treatment. This allows the front cover 8, side plates 6 and 31, substrate 1 and electrode frames F to be fixed and hermetically sealed to each other by heating to form a casing. Thereafter, the casing is evacuated through the evacuation tube (not shown), which is then sealed to keep the casing at vacuum pressure. During formation of the casing, heat expansion of the supporting rods 21 and 22 due to heating allows the electrode frames F to be adequately pulled at both ends thereof in the opposite direction, because the rods 21 and 22 have a thermal expansion coefficient several times as large as that of the electrode frames F. Thus, tension may be applied to the electrode frames F which is sufficient to prevent sagging of the electrode frames during the operation of the fluorescent display device.

Thus, in the finished fluorescent display device, the so-tensed electrode frames F, as shown in FIG. 2, are stretched through the spacers 29 and 30 in the space between the substrate 1 and the front cover 8, and the long and short connecting portions 14 and 15 are adapted to be led out together to the outside of the vacuum casing.

Then, the respective short connecting portions 15 of the electrode frames F are cut away in proximity to the connection with the fine wire-like electrode portions 13 to lead out only the long connecting portions 14 arranged at intervals of the predetermined distance P through the side plates 31 to the outside of the vacuum casing, as shown in FIG. 1. The connecting portions 14 are connected thereto the terminals of an external control circuit by soldering or the like, and the frame section 16 formed integral with the connecting portions 14 are cut away.

In the so-formd fluorescent display device, a plurality of the fine wire-like electrode portions 13 uniformly stretched with high density and without sagging which act as control electrodes form a matrix of high density together with the anode conductors 2 arranged in a stripe shape. Thus, the fluorescent display device can carry out uniform graphical display of high density because the electrode portions 13 never sags even at the emission.

The embodiment described hereinbefore is constructed in the manner that only control electrodes are formed by the linear electrodes and the anode conductors are depositedly arranged in a stripe-like shape on the inner surface of the substrate, to thereby form a matrix. However, in the present invention, the anode conductors may be likewise formed by linear electrodes and form a matrix together with the control electrodes. In this instance, the ends of the fine wire-like anode conductors each may be formed into a wide flat shape. Also, the change in size of the electrode frame may be easily accomplished by exchanging the tension members or moving the tension members with respect to the supporting rods.

As many apparently widely different embodiments of the invention may be made without departing from the spirit and scope thereof, it is to be understood that the invention is not limited to the specific embodiment thereof except as defined in the appended claims.

What is claimed is:

1. A process for preparing a linear electrode construction for a fluorescent display device comprising the steps of:

forming at least one electrode frame by arranging fine wire-like electrode sections side by side at intervals of a predetermined distance and forming connecting terminal sections integral with said electrode sections at both ends of said electrode sections which have a width larger than said electrode sections, said connecting terminal sections at both ends of each of said electrode sections being formed to be different in length from each other;

stretching said electrode frame in a space defined above a substrate forming a part of a vacuum casing of said fluorescent display device;

applying tension to said fine wire-like electrode sections of said electrode frame in the longitudinal direction thereof and mounting said electrode frame with respect to said vacuum casing in a manner to lead out said electrode sections and connecting terminal sections of said electrode frame to the exterior of said vacuum casing through a spacer means fixed on said substrate; and cutting away the portions of said electrode sections outward extending from said vacuum casing.

2. A process for preparing a linear electrode as defined in claim 1 wherein two electrode frames are superposed on each other in a manner such that the longer connecting terminal sections of one electrode frame are alternated with the shorter connecting terminal portions of the other electrode frame and stretched in said space above said substrate;

said tension is applied to the electrode sections of said both electrode frames and said both electrode frames are mounted with respect to said vacuum casing in a manner such that said electrode sections and connecting terminal sections of said both electrode frames are led out to the exterior of said vacuum casing through said spacer means fixed on said substrate; and the portions of said electrode sections outward extending from said vacuum casing are selectively cut away.

* * * * *